US009126082B2

(12) United States Patent
Schacht

(10) Patent No.: US 9,126,082 B2
(45) Date of Patent: Sep. 8, 2015

(54) WEIGHTED SPORTS TRAINING EQUIPMENT

(71) Applicant: Eric L. Schacht, Champaign, IL (US)

(72) Inventor: Eric L. Schacht, Champaign, IL (US)

( * ) Notice: Subject to any disclaimer, the term of this patent is extended or adjusted under 35 U.S.C. 154(b) by 0 days.

(21) Appl. No.: 14/272,246

(22) Filed: May 7, 2014

(65) Prior Publication Data

US 2014/0335967 A1 Nov. 13, 2014

Related U.S. Application Data

(60) Provisional application No. 61/820,491, filed on May 7, 2013.

(51) Int. Cl.

| | |
|---|---|
| ***A63B 69/36*** | (2006.01) |
| ***A63B 59/00*** | (2015.01) |
| ***A63B 21/00*** | (2006.01) |
| ***A63B 21/072*** | (2006.01) |
| ***A63B 59/06*** | (2006.01) |
| ***A63B 15/00*** | (2006.01) |
| ***A63B 49/02*** | (2015.01) |
| ***A63B 49/08*** | (2015.01) |
| ***A63B 53/14*** | (2015.01) |

(52) U.S. Cl.

CPC ..... *A63B 21/1469* (2013.01); *A63B 15/00* (2013.01); *A63B 21/072* (2013.01); *A63B 49/0288* (2013.01); *A63B 49/08* (2013.01); *A63B 53/14* (2013.01); *A63B 53/145* (2013.01); *A63B 59/0014* (2013.01); *A63B 59/06* (2013.01); *A63B 69/3638* (2013.01); *A63B 2210/50* (2013.01)

(58) Field of Classification Search

USPC ..... 473/219, 226, 231, 233, 256, 257, 297, 473/437, 457, 461, 463

See application file for complete search history.

(56) References Cited

U.S. PATENT DOCUMENTS

| | | | | |
|---|---|---|---|---|
| 1,138,196 | A * | 5/1915 | Diehl | 482/106 |
| 4,600,195 | A * | 7/1986 | Hunter | 473/297 |
| 4,887,815 | A * | 12/1989 | Hughes et al. | 473/291 |
| 4,984,801 | A * | 1/1991 | DeBack | 473/234 |
| 5,215,307 | A * | 6/1993 | Huffman | 473/409 |
| 5,380,003 | A * | 1/1995 | Lanctot | 473/520 |
| 5,741,193 | A * | 4/1998 | Nolan | 473/457 |
| 5,769,734 | A * | 6/1998 | Qualey, Sr. | 473/233 |
| 6,083,116 | A * | 7/2000 | Loredo | 473/256 |
| 6,599,201 | B1 | 7/2003 | Grant | |
| 6,692,386 | B2 | 2/2004 | Brundage | |
| 7,115,042 | B2 * | 10/2006 | Gulan et al. | 473/256 |
| 7,909,705 | B2 * | 3/2011 | Gill et al. | 473/297 |
| 8,444,500 | B2 | 5/2013 | Erkkinen | |
| 8,444,502 | B2 * | 5/2013 | Karube | 473/297 |
| 2003/0157990 | A1 * | 8/2003 | Bloom, Jr. | 473/292 |

(Continued)

OTHER PUBLICATIONS

Kravitz, "Kettlebell Research: What Science Says," IDEA Health & Fitness Association, available at http://www.ideafit.com/fitness-library/kettlebell-research-what-science-says, (Feb. 2013).

(Continued)

*Primary Examiner* — Nini Legesse

(74) *Attorney, Agent, or Firm* — Drinker Biddle & Reath LLP

(57) ABSTRACT

An apparatus for sports training includes a weighted body portion having a handle at a first end of the weighted body. A sports equipment portion is attached to a second end of the weighted body. The sports equipment portion corresponds to actual sport equipment.

20 Claims, 5 Drawing Sheets

(56) References Cited

U.S. PATENT DOCUMENTS

| | | | | |
|---|---|---|---|---|
| 2004/0248676 | A1* | 12/2004 | Taylor et al. | 473/513 |
| 2006/0122000 | A1 | 6/2006 | Paredes et al. | |
| 2008/0202317 | A1* | 8/2008 | Capotosto | 84/422.4 |

OTHER PUBLICATIONS

Contreras, "Kettlebell Swings: Go Heavier for Greater Glute and Hamstring Activation", The Glute Guy, available at, http://bretcontreras.com/kettlebell-swings-go-heavier-for-greater-glute-and-hamstring-activation/ (Aug. 2013).

Abstract of Beardsley et al. "The Role of Kettlebells in Strength and Conditioning: A Review of the Literature," Strength and Conditioning Journal, vol. 36, No. 3, available at http://journals.lww.com/nsca-scj/Abstract/publishahead/The_Role_of_Kettlebells_in_Strength_and.99576.aspx (Apr. 2014).

* cited by examiner

WEIGHTED SPORTS TRAINING EQUIPMENT

CROSS-REFERENCE TO RELATED APPLICATION

This disclosure claims the benefit of U.S. Provisional Patent Application No. 61/820,491, filed May 7, 2013, entitled "A Variably Weighted Double Handled Athletic Training Device with Attachments for Sporting Equipment, Including but Not Limited to Tennis, Golf, and Baseball."

FIELD OF THE DISCLOSURE

The present disclosure relates generally to athletic training equipment, and more particularly, to training equipment for sports involving hitting or throwing an object with a hand held equipment.

BACKGROUND

Resistance weight training is often used for sports training and muscle development. For example, many athletes use free weights or weight training machines to improve muscle strength and endurance. Using free weights or weight training machines, while improving the muscles in general, does not necessarily improve the muscles used in particular sports motions, such as swinging a golf club.

Additionally, U.S. Pat. No. 6,599,201 describes a weight training apparatus that clamps to a shaft of a golf club.

U.S. Pat. No. 6,692,386 describes a baseball bat with a hollow cavity in which weights can be inserted.

U.S. Pat. No. 8,444,500 describes a flexible, crescent-shaped, weighted tube that can be slipped onto the shaft of golf club or baseball bat, or on the end of a tennis racket.

SUMMARY OF THE DISCLOSURE

In an embodiment, an apparatus for sports training comprises a weighted body portion having a handle at a first end of the weighted body; and a sports equipment portion attached to a second end of the weighted body, the sport equipment portion corresponding to actual sport equipment.

In another embodiment, an apparatus for sports training comprises a weighted body having: a handle at a first end of the weighted body, and an attachment portion at a second end of the weighted body, wherein the attachment portion is configured to attach a sports equipment device or devices corresponding to actual sport equipment.

In yet another embodiment, an apparatus is for use with a sports training device comprising a weighted body having a handle at a first end of the weighted body. The apparatus comprises a sports equipment device configured to attach to a second end of the weighted body, wherein the sports equipment device corresponds to actual sport equipment.

DETAILED DESCRIPTION

An ergonomically proper double handled weighted swing sporting equipment would benefit many types of athletes looking to improve core strength, stability in swing, muscle tone and muscle memory, while also simulating competitive swinging motions.

In example embodiments described below, a sporting equipment training device includes a weighted body portion (e.g., a kettlebell or a modified kettlebell) and a sporting equipment portion (e.g., a distal portion of a tennis racket, a distal portion of a golf club, a distal portion of a baseball bat, etc.). The weighted body portion is at a proximal end of the sporting equipment training device at or near where a user is to hold the sporting equipment training device. The sporting equipment portion is at a distal end of the sporting equipment training device. In such embodiments, a center of gravity is near to hands of a user while holding the sporting equipment training device so that the device is not head-heavy and a core of a user's body and arms of the user work together during the simulated training and drilling.

In some embodiments, the weighted body portion includes a handle portion (e.g., a single handle, two handles, etc.) onto which the user grasps during use of the sporting equipment training device. For example, in an illustrative embodiment, the weighted body portion is a kettlebell or modified kettlebell, and the handle portion comprises handles of the kettlebell. A length of the sporting equipment portion is designed such that a length of the sporting equipment training device corresponds to a length of an actual sporting equipment device, thus facilitating more accurate swinging motion during training.

Figure 1:
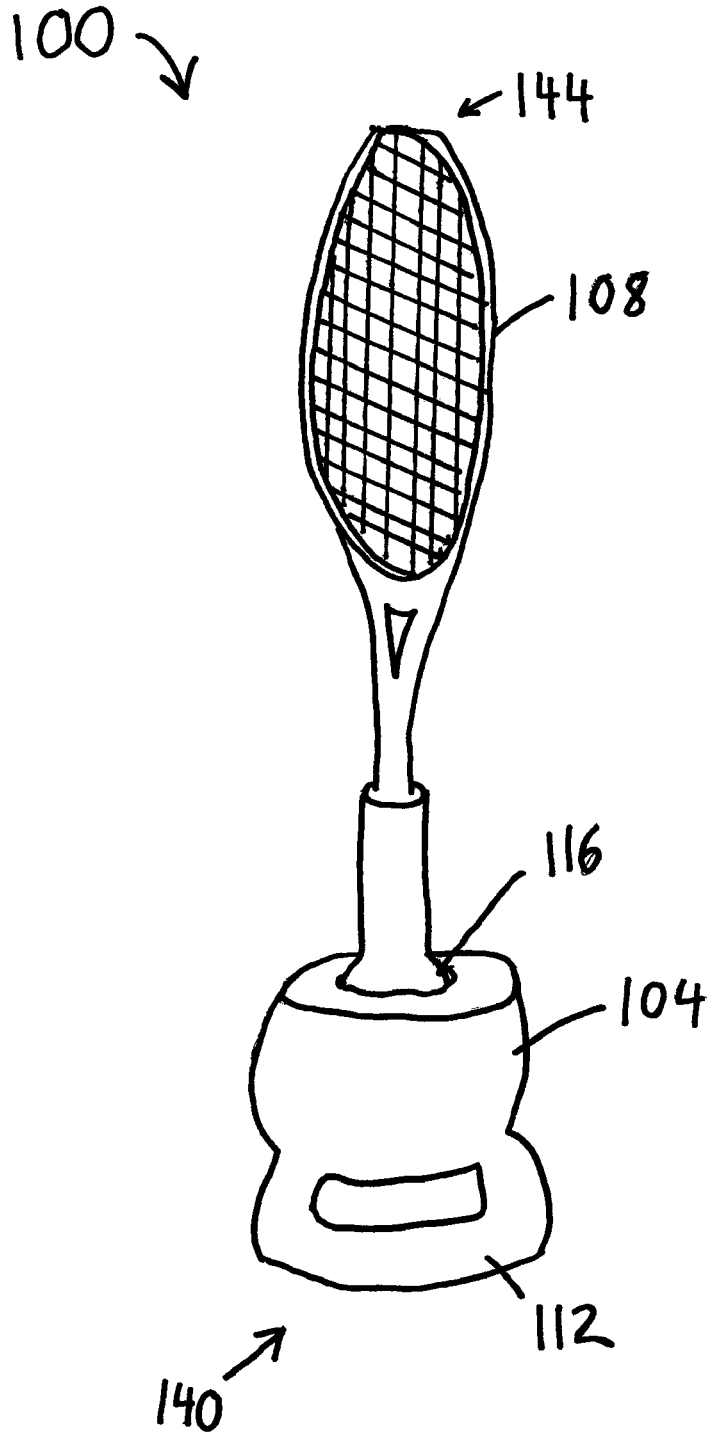
FIG. 1 is a diagram of an example sporting equipment training device, according to an embodiment.

FIG. 1 is a diagram of an example sporting equipment training device 100 for tennis training, according to an embodiment. The device 100 includes weighted body portion 104 attached to a tennis racket portion 108. In an embodiment, the weighted body portion 104 comprises a kettlebell or modified kettlebell. In other embodiments, the weighted body portion 104 is another suitable weighted device. The weighted body portion 104 includes (or is coupled to) a handle portion 112. In an embodiment, the handle portion 112 comprises a single handle configured to permit a user to grasp the handle with two hands, if desired by the user. In other embodiments, the handle portion 112 comprises two separate handles, each configured to permit the user to grasp the respective handle with a respective hand. In other embodiments, the handle portion 112 is configured to permit the user to grasp the handle portion 112 with at most one hand.

In an embodiment, the tennis racket portion 108 includes a flange 116 configured to permit attachment of the tennis racket portion 108 to the weighted body portion 104. For example, in an embodiment, the flange 116 includes a suitable number of apertures (e.g., 2, 3, 4, 5, etc.) for accepting bolts, screws, etc., that can be screwed, for example, into threaded openings (not shown in FIG. 1) in the weighted body portion 104 for attaching the tennis racket portion 108 to the weighted body portion 104. In other embodiments, the flange 116 is configured to cooperatively mate with an attachment component (not shown in FIG. 1) of the weighted body portion 104 to facilitate attaching the tennis racket portion 108 to the weighted body portion 104.

Various other suitable attachment techniques/devices/components can be utilized (alternatively or additionally) for attaching the tennis racket portion 108 to the weighted body portion 104, for permanently attachment, semi-permanent attachment, or removable attachment. As an illustrative example, the tennis racket portion 108 may be attached to the weighted body portion 104 using an epoxy, by welding, etc. As another illustrative example, the attachment component (not shown in FIG. 1) of the weighted body portion 104 may include one or more clamping and/or clipping devices configured to clamp and/or clip the flange 116 to the weighted body portion 104. As yet another illustrative example, the attachment component (not shown in FIG. 1) of the weighted body portion 104 may include a threaded shaft and the tennis racket portion 108 include a threaded hollow in a shaft of the tennis racket portion 108 to permit the tennis racket portion 108 to be screwed onto the threaded shaft of the weighted body portion 104.

Figure 2:
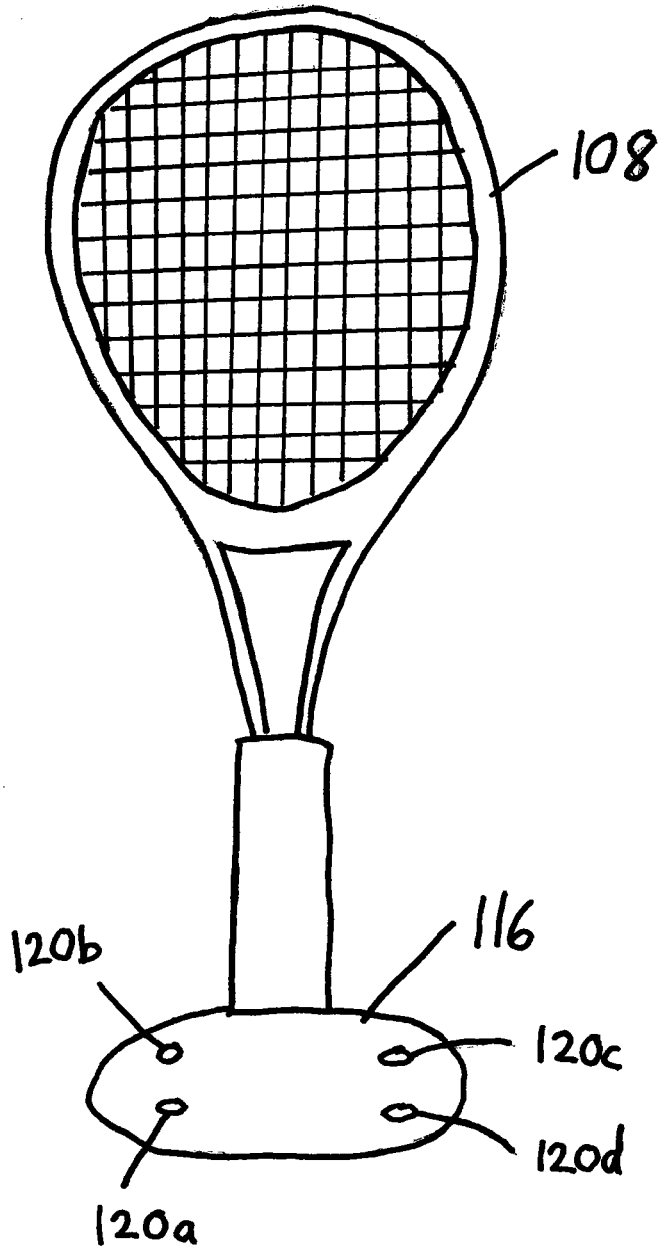
FIG. 2 is a view of a sporting equipment portion of the sporting equipment training device of FIG. 1, according to an embodiment.

FIG. 2 is a view of the tennis racket portion 108 of FIG. 1, according to an embodiment. As can be seen in FIG. 2, the flange 116 includes a plurality of apertures 120 for accepting bolts, screws, etc., that can be screwed, for example, into threaded openings in the weighted body portion 104 for attaching the tennis racket portion 108 to the weighted body portion 104.

Figure 3:
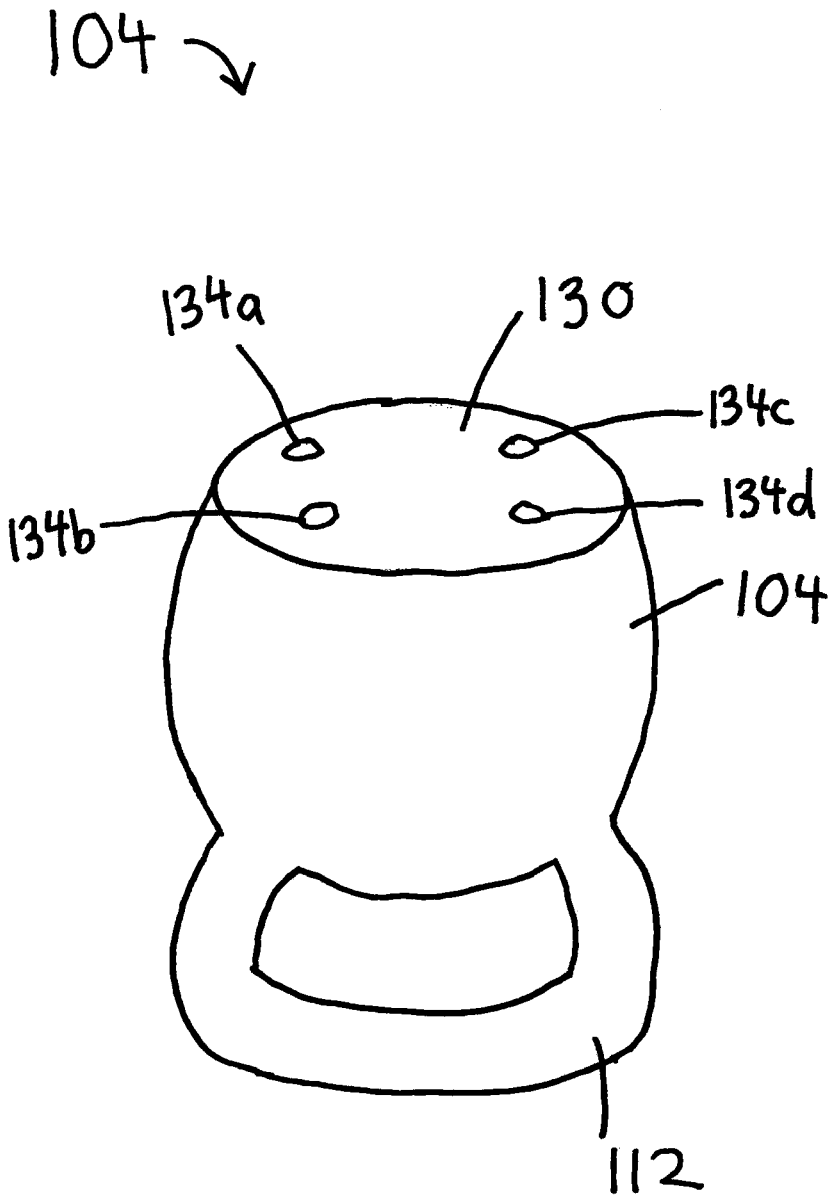
FIG. 3 is a view of a weighted body portion of the sporting equipment training device of FIG. 1, according to an embodiment.

FIG. 3 is a view of the weighted body portion 104 of FIG. 1, according to an embodiment. As can be seen in FIG. 3, the weighted body portion 104 includes a surface 130 having a plurality of openings 134. The plurality of openings 134 are configured (e.g., are threaded) to accept bolts, screws, etc., that pass through the apertures 120 in the flange 116 for attaching the tennis racket portion 108 to the weighted body portion 104.

Referring again to FIG. 1, a length of the device 100 (e.g., from a proximal end 140 of the device 100 to a distal end 144 of the device) corresponds to a length of an actual tennis racket, in an embodiment. For example, a length of the tennis racket portion 108 is configured such that, when the tennis racket portion 108 is attached to the weighted body portion 104, the length of the device 100 corresponds to the length of the actual tennis racket, in an embodiment.

In an embodiment, the device 100 is configured such that a center of gravity of the device 100 is near the hand (if the device is being held by only one hand) or hands (if the device is being held by both hands) of the user. For example, in an embodiment, the center of gravity of the device 100 is within one fourth of the length of the device 100 from the proximal end 140. In another embodiment, the center of gravity of the device 100 is within one third of the length of the device 100 from the proximal end 140.

Figure 4:
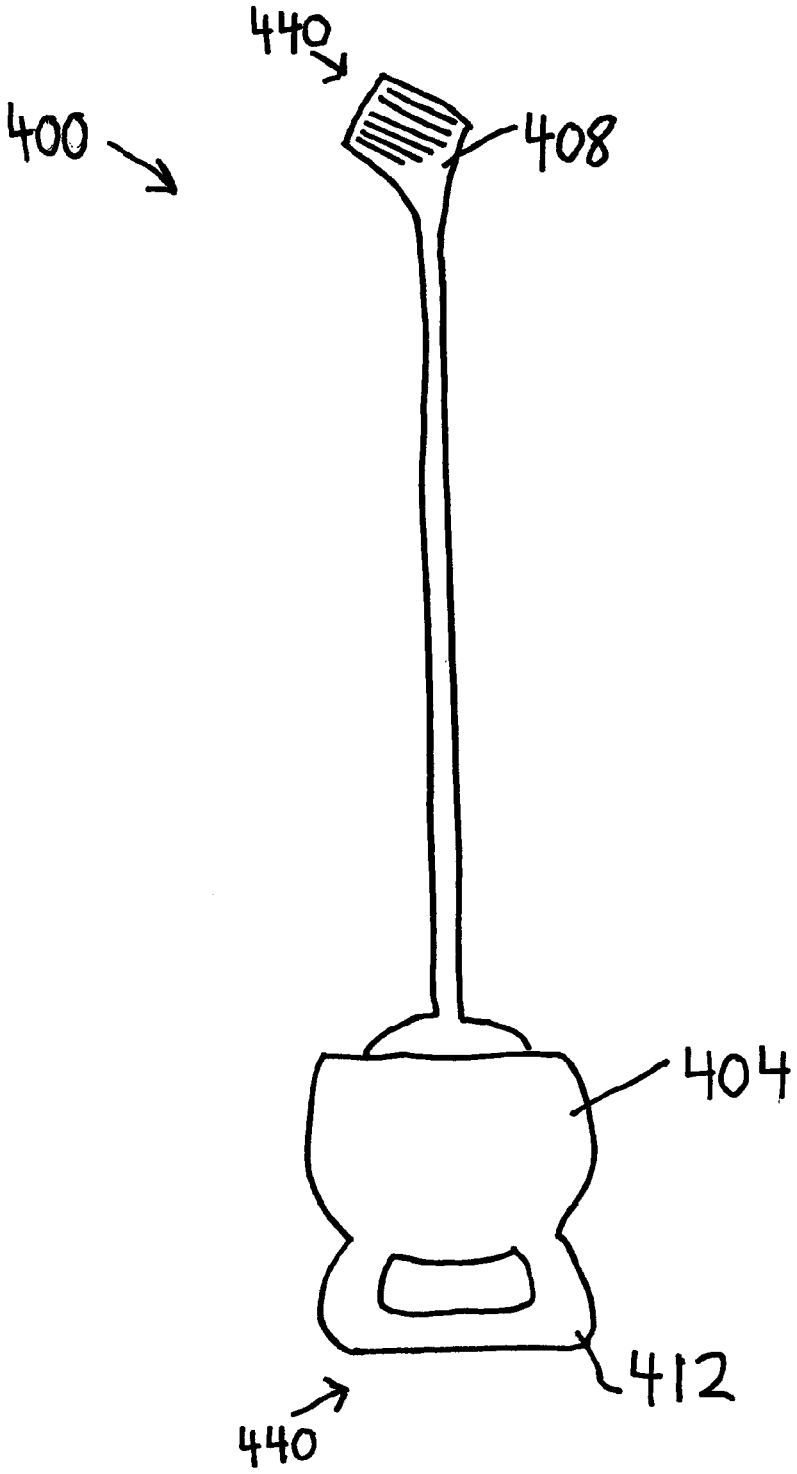
FIG. 4 is a diagram of another example sporting equipment training device, according to another embodiment.

Although an example was discussed above in the context of tennis, in other embodiments, similar training devices for other types of sports can be utilized. For instance, FIG. 4 is a diagram of an example sporting equipment training device 400 for golf training, according to an embodiment. The device 400 includes a weighted body portion 404 attached to a golf club portion 408. In an embodiment, the weighted body portion 404 comprises a kettlebell or modified kettlebell. In other embodiments, the weighted body portion 404 is another suitable weighted device. The weighted body portion 404 includes (or is coupled to) a handle portion 412. Similar to the discussion above, different types of handles can be utilized in different embodiments. Also, similar to the discussion above, the golf club portion 408 can be attached to the weighted body portion 404 using various techniques and/or mechanisms in various embodiments.

In an embodiment, a length of the device 400 (e.g., from a proximal end 440 of the device 400 to a distal end 444 of the device 400) corresponds to a length of an actual golf club. For example, a length of the golf club portion 408 is configured such that, when the golf club portion 408 is attached to the weighted body portion 404, the length of the device 400 corresponds to the length of the actual golf club, in an embodiment.

Figure 5:
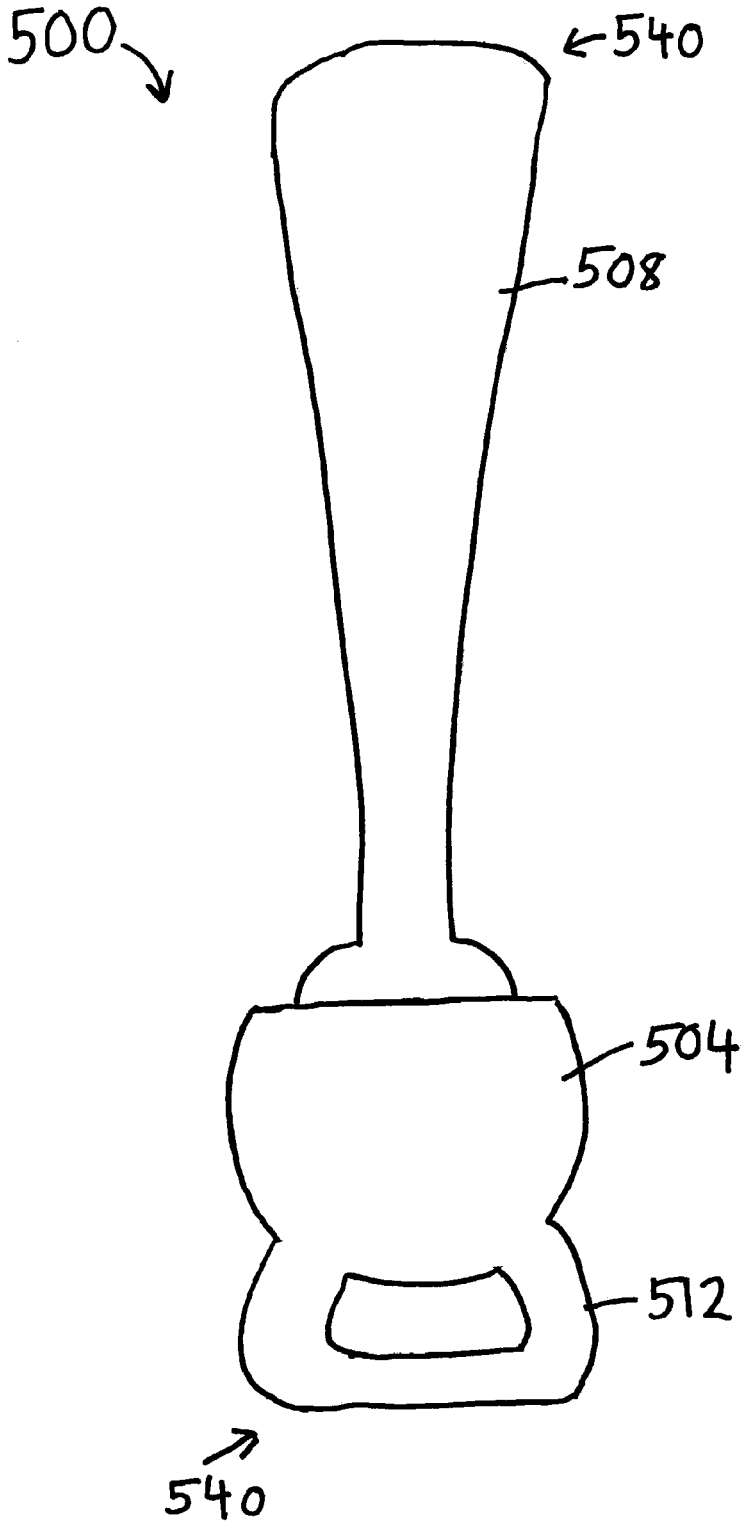
FIG. 5 is a diagram of yet another example sporting equipment training device, according to yet another embodiment.

FIG. 5 is a diagram of an example sporting equipment training device 500 for baseball training, according to an embodiment. The device 500 includes a weighted body portion 504 attached to a baseball bat portion 508. In an embodiment, the weighted body portion 504 comprises a kettlebell or modified kettlebell. In other embodiments, the weighted body portion 504 is another suitable weighted device. The weighted body portion 504 includes (or is coupled to) a handle portion 512. Similar to the discussion above, different types of handles can be utilized in different embodiments. Also, similar to the discussion above, the baseball bat portion 508 can be attached to the weighted body portion 404 using various techniques and/or mechanisms in various embodiments.

In an embodiment, a length of the device 500 (e.g., from a proximal end 540 of the device 500 to a distal end 544 of the device 500) corresponds to a length of an actual baseball bat. For example, a length of the baseball bat portion 508 is configured such that, when the baseball bat portion 508 is attached to the weighted body portion 504, the length of the device 500 corresponds to the length of the actual baseball bat, in an embodiment.

In some embodiments, the devices 400/500 described with respect to FIGS. 4 and 5, are configured such that respective centers of gravity of the devices 400/500 are near the hand (if the device is being held by only one hand) or hands (if the device is being held by both hands) of the user. For example, in some embodiments, the centers of gravity of the devices 400/500 are within one fourth of the respective lengths of the devices 4400/500 from respective proximal ends 440/540. In another embodiment, the respective centers of gravity of the devices 400/500 are within one third of the respective length of the devices 400/500 from the respective proximal ends 440/540.

In some embodiments, a weighted body portion (e.g., 104 in FIG. 1, 404 in FIG. 4, 504 in FIG. 5) and various sports equipment portions (e.g., 108 in FIG. 1, 408 in FIG. 4, 508 in FIG. 5) are configured to removably attach with one another such that the weighted body portion can be utilized with different sports equipment portions and/or a sports equipment portion can be utilized with different weighted body portions (e.g., having different weights).

In some embodiments, the weighted body portion with handle(s) is configured to evenly disperse weight of the weighted body portion between the two hands/arms at a comfortable weight such that a sports swing can be properly simulated. In some embodiments, a length of the training device with the sports equipment portion attached is corresponds to a length of an actual sports equipment to actually permit a user to impact a sports object (e.g., a ball) for training purposes and to do so at a proper distance from the user to fully simulate a competitive swing situation.

In some embodiments, the weighted body portion can be modified to add or subtract weight. For example, additional weight could be affixed to the weighted body portion using a suitable attachment technique and/or mechanism.

In other embodiments, similar sporting equipment training devices are provided for other types of sports such as badminton, hockey, lacrosse, etc.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. An apparatus for sports training, the apparatus comprising:

a sports equipment portion corresponding to actual sports equipment, wherein the actual sports equipment comprises one of a tennis racket, a badminton racket, a golf club, a baseball bat, or a hockey stick, the actual sports equipment comprises a shaft with a head portion at a distal end of the shaft, a first handle of the actual sports equipment is provided at a proximate end of the shaft, the first handle at an orientation aligned with a longitudinal axis of the shaft, the actual sports equipment is configured for a user to grasp the first handle with two hands while swinging the actual sports equipment to hit an object with the head portion of the actual sports equipment, with a first hand of the user located closer to the head portion of the actual sports equipment than a second hand of the user, and the sports equipment portion includes a head portion corresponding to the head portion of the actual sports equipment; and a weighted body portion attached to the sports equipment portion, wherein the weighted body portion includes a second handle at a different orientation than the orientation of the first handle such that, when the user grasps the second handle with two hands, the first hand and the second hand are equidistant from the head portion of the sports equipment portion, and weight of the apparatus is dispersed evenly to a first arm of the user and a second arm of the user;

wherein the apparatus is configured for a user to train with the apparatus by simulating, while holding the second handle, a swinging motion utilized when the user swings the actual sports equipment, and a center of gravity of the apparatus is located within one third of a length of the apparatus from the second handle.

2. The apparatus of claim 1, wherein the weighted body portion comprises a kettlebell.

3. The apparatus of claim 1, wherein a distance from the second handle to a distal end of the sports equipment portion corresponds to a length of the actual sport equipment.

4. The apparatus of claim 1, wherein the sport equipment portion corresponds to a sports racket, a sports bat, or a golf club.

5. The apparatus of claim 1, wherein:

the second handle is at a proximate end of the weighted body portion, and the weighted body portion includes an attachment mechanism at a distal end of the weighted body portion, wherein the attachment mechanism is configured to removably attach the sports equipment portion.

6. The apparatus of claim 1, wherein the weighted body portion is attached to the sports equipment portion using at least a plurality of screws or bolts.

7. An apparatus for training a swing of at least one actual sports equipment from a group consisting of a tennis racket, a badminton racket, a golf club, a baseball bat, or a hockey stick, wherein each actual sports equipment comprises a shaft with a head portion at a distal end of the shaft, a first handle of the actual sports equipment is provided at a proximate end of the shaft, the first handle at an orientation aligned with a longitudinal axis of the shaft, and the actual sports equipment is configured for a user to grasp the first handle with two hands while swinging the actual sports equipment to hit an object with the head portion of the actual sports equipment, with a first hand of the user located closer to the head portion of the actual sports equipment than a second hand of the user, the apparatus comprising:

a weighted body having:

a second handle at a first end of the weighted body, and an attachment portion at a second end of the weighted body, wherein the attachment portion is configured to attach a sports equipment device or devices corresponding to the actual sports equipment, wherein each sports equipment device includes a respective head portion corresponding to the respective head portion of the actual sports equipment, and the second handle is at a different orientation than the orientation of the first handle such that, when the weighted body is attached to the sports equipment device and the user grasps the second handle with two hands, the first hand and the second hand are equidistant from the head portion of the sports equipment device, and weight of an apparatus comprising the weighted body attached to the sports equipment device is dispersed evenly to a first arm of the user and a second arm of the user; and wherein the apparatus is configured for a user to train with the apparatus by simulating, while holding the second handle, a swinging motion utilized when the user swings the actual sports equipment, and a center of gravity of the apparatus is located within one third of a length of the apparatus from the second handle.

8. The apparatus of claim 7, wherein the weighted body comprises a kettlebell.

9. The apparatus of claim 7, wherein the handle is configured to be gripped by two hands.

10. The apparatus of claim 7, wherein the weighted body includes an attachment mechanism at the attachment portion.

11. The apparatus of claim 10, wherein the attachment mechanism comprises a threaded shaft.

12. The apparatus of claim 10, wherein the attachment mechanism comprises a clamping mechanism and/or a clipping mechanism.

13. An apparatus for training a swing of an actual sports equipment from a group consisting of a tennis racket, a badminton racket, a golf club, a baseball bat, or a hockey stick, wherein the actual sports equipment comprises a shaft with a head portion at a distal end of the shaft, a first handle of the actual sports equipment is provided at a proximate end of the shaft, the first handle at an orientation aligned with a longitudinal axis of the shaft, and the actual sports equipment is configured for a user to grasp the first handle with two hands while swinging the actual sports equipment to hit an object with the head portion of the actual sports equipment, with a first hand of the user located closer to the head portion of the actual sports equipment than a second hand of the user, the apparatus for use with a weighted body that includes a second handle at a first end of the weighted body, the apparatus comprising:

a sports equipment device configured to attach to a second end of the weighted body, wherein the sports equipment device corresponds to the actual sport equipment, the sports equipment device includes a head portion that corresponds to the head portion of the actual sports equipment, when the sports equipment device is attached to the weighted body, the second handle is at a different orientation than the orientation of the first handle such that, when the user grasps the second handle with two hands, the first hand and the second hand are equidistant from the head portion of the sports equipment device, and weight of an apparatus comprising the sports equipment device attached to the weighted body is dispersed evenly to a first arm of the user and a second arm of the user, the apparatus is configured for a user to train with the apparatus by simulating, while holding the second handle, a swinging motion utilized when the user swings the actual sports equipment, and a center of gravity of the apparatus is located within one third of a length of the apparatus from the second handle.

14. The apparatus of claim 13, wherein the sports equipment device comprises a flange.

15. The apparatus of claim 14, wherein the flange is configured to mate with an attachment portion on the second end of the weighted body.

16. The apparatus of claim 14, wherein the flange comprises a plurality of apertures via which screws or bolts can be attached to the weighted body.

17. The apparatus of claim 14, wherein:

the weighted body includes a clamping mechanism; and the sport equipment device is configured to cooperate with the clamping mechanism.

18. The apparatus of claim 14, wherein the sport equipment device corresponds to a sport racket.

19. The apparatus of claim 14, wherein the sport equipment device corresponds to a sport bat.

20. The apparatus of claim 14, wherein the sport equipment device corresponds to a golf club.

* * * * *